US005375641A

United States Patent [19]

Schlueter

[11] Patent Number: 5,375,641

[45] Date of Patent: Dec. 27, 1994

[54] MODULAR PANEL SYSTEM

[75] Inventor: Donald D. Schlueter, Detroit, Mich.

[73] Assignee: Good Impressions, Inc., Oak Park, Mich.

[21] Appl. No.: 59,830

[22] Filed: May 11, 1993

[51] Int. Cl.[5] ..... A47G 5/00

[52] U.S. Cl. ..... 160/135; 160/231.1

[58] Field of Search ..... 160/135, 351, 229.1, 160/352, 231:1; 52/239, 238.1, 240; 40/605, 606, 610

[56] References Cited

U.S. PATENT DOCUMENTS

| | | | |
|---|---|---|---|
| 1,944,696 | 1/1934 | Reichl . | |
| 2,210,652 | 8/1940 | Dennett . | |
| 3,913,656 | 10/1975 | Guyer | 160/135 |
| 4,711,046 | 12/1987 | Herrgord | 40/605 |
| 4,744,184 | 5/1988 | Kramer | 52/227 |
| 4,821,787 | 4/1989 | Swanson | 160/135 |
| 4,926,609 | 5/1990 | Arico | 52/582 |
| 5,115,855 | 5/1992 | Lindblom et al. | 160/135 |
| 5,125,193 | 6/1992 | Beaulieu | 160/135 X |
| 5,131,448 | 7/1992 | Miller | 160/135 |
| 5,193,603 | 3/1993 | Whisnant | 160/135 |
| 5,220,952 | 6/1993 | Beaulieu | 160/135 X |

*Primary Examiner*—David M. Purol

[57] ABSTRACT

A modular panel system suitable for erecting a free-standing portable exhibit display, or room partition, utilizes a plurality of lightweight structural panels interconnected across the entire horizontal length of the display, or partition, by a plurality of elastic connecting members. Vertically abutting structural panels are interconnected by a plurality of rigid connecting members. The structural panels accommodate the elastic and rigid connecting members through insertion into a first set of horizontally extending parallel channels internal to each panel, and a second set of vertically extending parallel channels internal to each panel. The overall weight of the present modular panel system is significantly reduced, while achieving a hinged relationship between horizontally abutting panels.

7 Claims, 2 Drawing Sheets

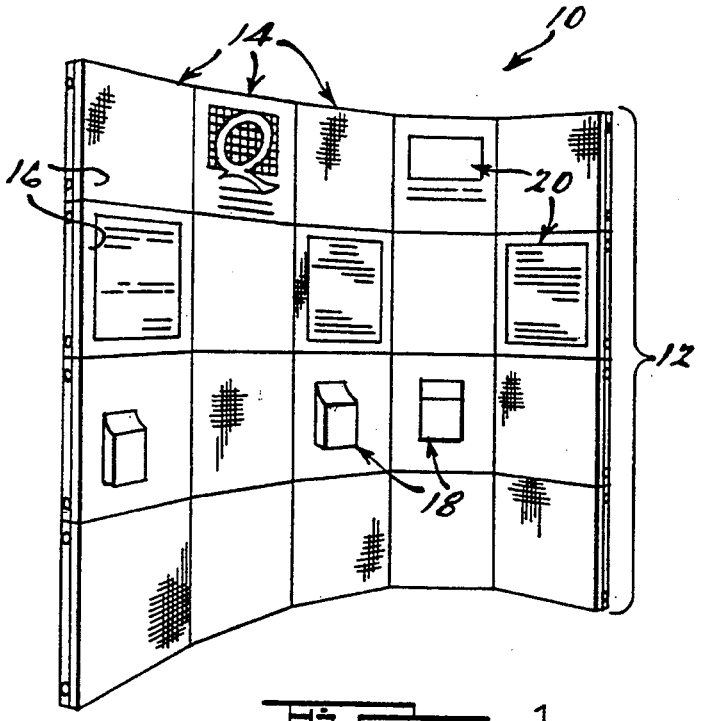
FIG. 1.
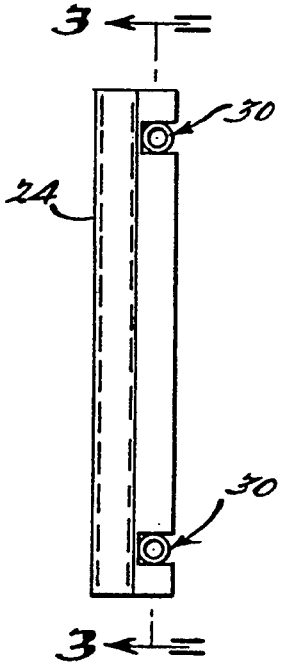
FIG. 2.
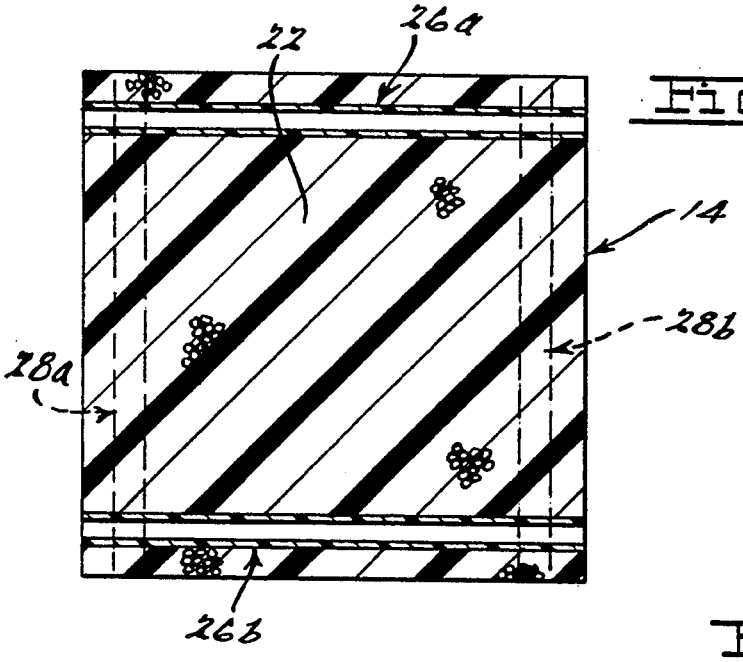
FIG. 3.
FIG. 6.
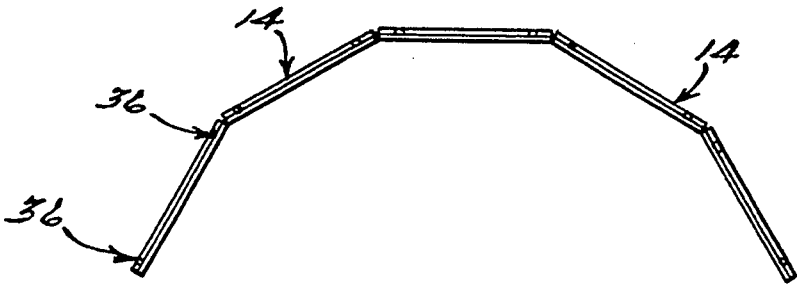

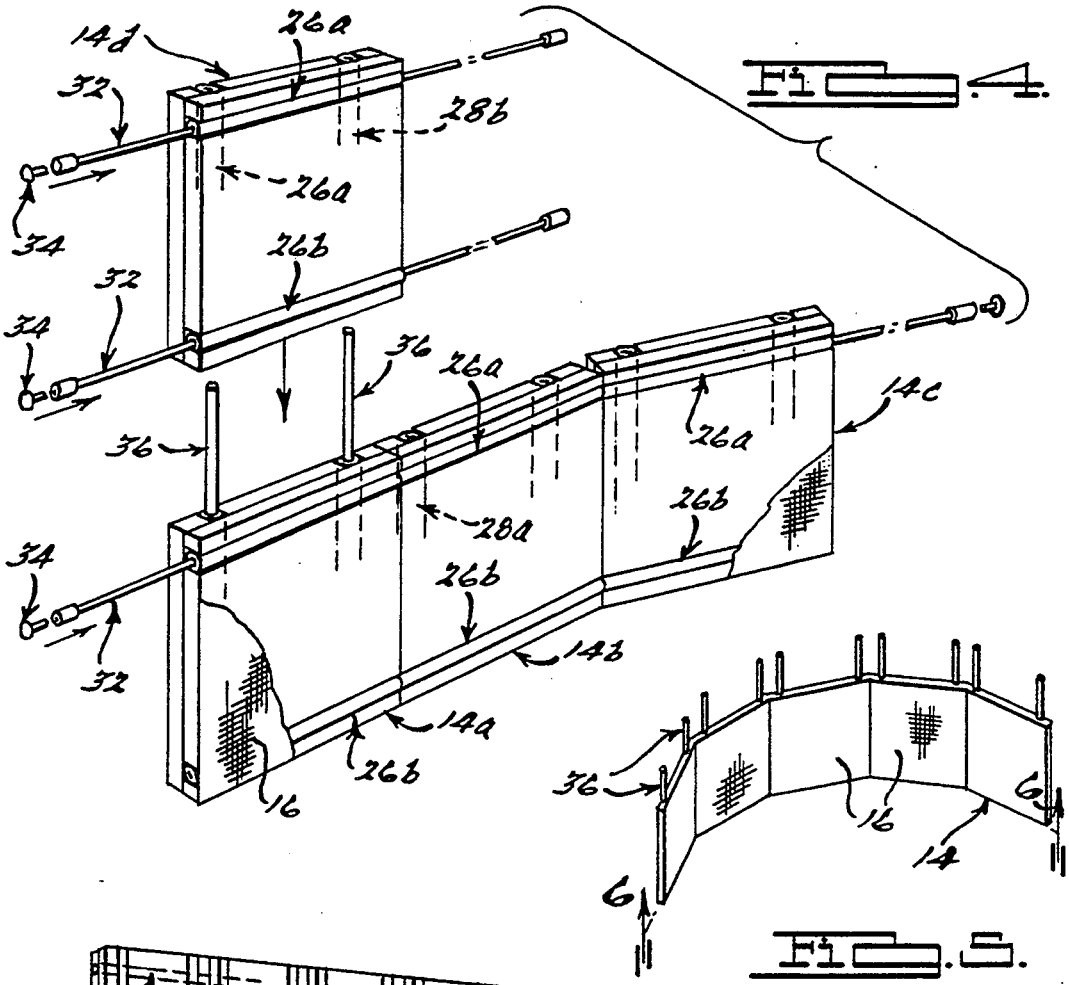
FIG. 4.
FIG. 5.
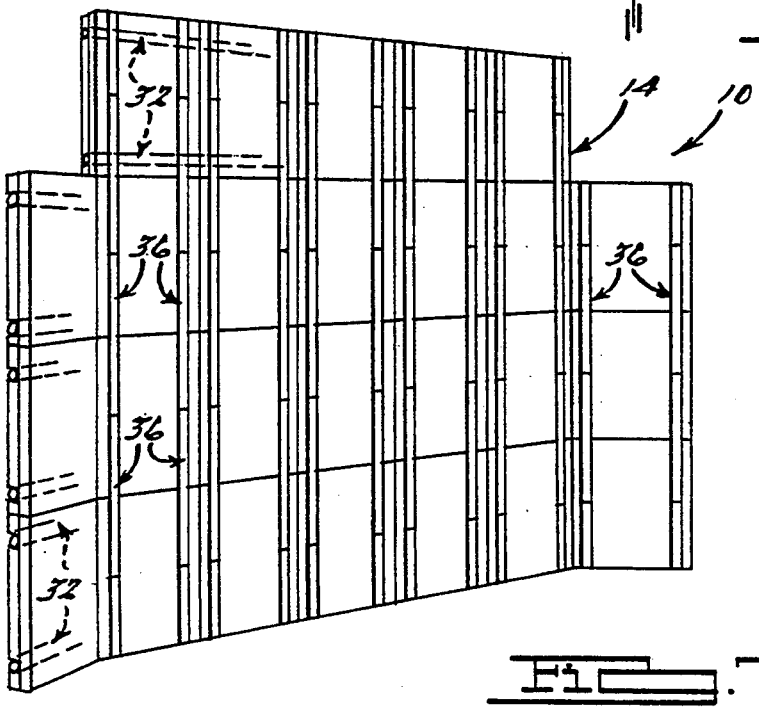
FIG. 7.

MODULAR PANEL SYSTEM

BACKGROUND OF THE INVENTION

The present invention relates generally to a freestanding modular wall system suitable for use as an exhibit display, or a room partition, and more particularly to a novel modular panel interconnection for simplifying the assembly process while achieving adjustable panel positioning across the entire length of the freestanding unit.

Portable displays have found wide usage in today's business environment, particularly with respect to businesses which participate in conventions, trade shows, seminars and other such events. Due to the nature of this application, portable displays are typically assembled and disassembled by a limited number of persons at the exhibition site. Thus, a basic design requisite of such portable display devices is a minimizing of weight and structural complexity, coupled with a maximizing of durability and aesthetic appearance. Generally, known portable display devices sacrifice one of these design factors in favor of another, i.e., known systems which are durable and attractive are also cumbersome, heavy and complicated assembly, or known systems which are lightweight and easy to assemble lack sufficient durability to withstand constant assembly and disassembly.

Another desirable design factor for portable displays emphasizes an ability to create a variety of different display configurations with a single portable display unit. Known portable displays have achieved variability in display configuration by way of a modular construction utilizing a plurality of panels, which are either rigidly fastened together in the desired configuration, or interconnected with a series of corresponding hinges to permit adjustable positioning of the panels into a desired configuration. However, known modular portable displays are generally unsatisfactory because the rigid or hinged interconnecting of the respective display panels adds weight and expense from the necessary joining structure, requires added structural reinforcement of each panel to accommodate the joining structure, provides an unaesthetic appearance, and increases the set-up time and complexity of the assembly process.

Furthermore, hinged interconnections are highly susceptible to wearage such as bending or breaking, which subsequently causes misalignment of the display panels. Such wearage further increases the cost of the display due to the inherent need for replacing the worn components.

SUMMARY OF THE INVENTION

It is therefore an object of the present invention to provide a modular panel system for erecting a freestanding portable display, or room partition, which is lightweight, durable, inexpensive to manufacture, and simple to assemble/disassemble.

It is another object of the present invention to provide a modular panel system for erecting a freestanding portable display, or room partition, which significantly reduces the susceptibility to wear and corresponding need for replacement and/or repair of components.

It is another object of the present invention to provide a modular panel system for erecting a freestanding portable display, or room partition, which provides an unrestricted number of possible assembly configurations.

It is another object of the present invention to provide a modular panel system which allows a selectively flexible or rigid interconnection between horizontally abutting panels.

It is another object of the present invention to provide a modular panel system for erecting a freestanding portable display, or room partition, which flexibly interconnects all horizontally abutting panels together, and rigidly interconnects vertically abutting panels.

In accordance with the present invention, a modular panel system for erecting a portable freestanding exhibit display, or room partition, comprises a plurality of structural panels which each has a first set of at least two parallel channels internally extending from one side of the panel to an opposite side. To effect an interconnection of horizontally abutting structural panels, a first plurality of connecting members are individually inserted into a respective one of the first set of at least two parallel channels in an end one of the horizontally abutting panels. Each connecting member of the first set of connecting members is then extended through a corresponding and aligning one of the first set of at least two parallel channels in the remaining horizontally abutting structural panels.

In further accordance with the present invention, each of the plurality of structural panels further comprises a second set of at least two parallel channels extending across the inside of the panel perpendicular to the first set of at least two parallel channels. To effect an interconnection of vertically abutting structural panels, a second plurality of connecting members are individually inserted into a respective one of the second set of at least two parallel channels in a particular one of the plurality of horizontally interconnected structural panels. Each connecting member of the second set of connecting members is then extended into a respective one of the second set of at least two parallel channels in a vertically abutting structure panel.

Each structural panel of the present invention is formed from at least two overlapping sheets of lightweight material. The first set of at least two parallel channels are formed in one of the at least two overlapping sheets, and the second set of at least two parallel channels are formed in another one of the at least two overlapping sheets. In a preferred embodiment, the first plurality of connecting members each comprises an elastic stretch chord. A securing means is attached to each end of the plurality of elastic stretch chords to secure each stretch chord in position relative to the interconnected, horizontally abutting structural panels. The second plurality of connecting members each comprise a rigid connecting rod.

The present invention will be more fully understood upon reading the following detailed description of the preferred embodiment in conjunction with the accompanying drawings.

BRIEF DESCRIPTION OF THE DRAWINGS

FIG. 1 is an illustration showing one possible freestanding portable exhibit display configuration using the modular panel system of the present invention;

FIG. 2 is a side view diagram schematically illustrating a single structural panel in accordance with the present invention;

FIG. 3 is a front view diagram of the structural panel shown in FIG. 2;

FIGS. 4 to 6 are diagrams illustrating the assembly process of a freestanding portable display utilizing the modular panel system of the present invention; and FIG. 7 is a schematical diagram of another possible freestanding portable exhibit display configuration illustrating the interconnecting members.

DETAILED DESCRIPTION OF THE PREFERRED EMBODIMENT OF THE INVENTION

Referring to FIG. 1, a modular panel system 10 in accordance with the present invention is shown in one possible freestanding portable display configuration 12. The modular panel system comprises a plurality of individual panels 14 which are flexibly adjoined in a horizontal plane across the entire length of the display 12, and rigidly adjoined in a vertical plane along the entire height of the display 12. Each panel 14 is provided with an outer covering comprised of any type of decorative material 16 suitable for mating with a fastening material such as VELCRO. In this manner, accessory items such as pamphlet holders 18, or display placards 20, can have the fastening material affixed to a back side to facilitate easy mounting on the display 12 in an aesthetically pleasing way.

Referring now to FIGS. 2 and 3, each panel 14 is formed from at least two sheets 22 and 24 of overlapping lightweight material, such as styrofoam or corrugated paper. Each sheet is provided with at least two parallel recesses, or grooves, which extend from one edge of a sheet to the other diametrically opposed edge. Respective channels **26*a* and 26*b*, and 28*a* and 28*b*, are then fashioned by placing a rigid tube 30 constructed of lightweight plastic into each recess. Alternatively, the channels could be integrally formed with the sheets such as by using a molded plastic material. The two sheets 22 and 24 are oriented relative to each other so that the channels 26*a* and 26*b* extend perpendicular to channels 28*a* and 28*b* in an overlapping relation. Additional sheets of lightweight material (not shown) can further be placed on top of sheets 22 and 24 to increase the overall thickness and structural integrity of each panel 14. A frame (not shown) constructed of durable, lightweight material, such as molded plastic, can be optionally located along the top, bottom, and side edges of sheets 22 and 24 to provide a protective shell, and to enhance the aesthetic appearance of the panels 14. The frame would be provided with holes which align with the respective channels 26*a* and 26*b*, and 28*a* and 28*b*. The outer covering 16 is affixed, e.g. with glue, to the outer exposed surfaces of sheets 22 and 24. If a frame is utilized, the covering 16 would be affixed to sheets 22 and 24** prior to placement of the frame about the sheets.

FIG. 4 illustrates the assembly process for constructing a display, or room partition, in accordance with the present invention. Generally, a plurality of panels 14 are interconnected in horizontal and vertical abutting relation to form an array of rows and columns. The panels 14 are interconnected across the entire horizontal length of the display, or room partition, by way of a set of elastic stretch chords 32. The elastic stretch chords 32 are each inserted into and extended through a respective one of the channels **26*a* and 26*b* of a first end panel 14*a* of the bottom row of the array, and then subsequently extended through respective channels 26*a* and 26*b* of each succeeding panel 14*b* and 14*c* until the stretch chord extends through a channel of an opposite end panel. A securing means, such as clasp mechanism 34, is attached to both ends of each elastic stretch chord 32, thereby creating a living hinge effect by elastically binding the entire row of horizontally abutting panels 14** together as a single flexible unit.

A subsequent row of panels 14 is then added to the bottom row by vertically connecting each panel 14 of the second row on top of one of the panels 14 of the bottom row. For example, as shown in FIGS. 5 and 6, a pair of rigid connector rods 36 are inserted into respective channels **28*a* and 28*b*of each panel 14 in the bottom row. Each connector rod 36 extends into the corresponding channel 28*a* or 28*b* by approximately half the height of the panel 14. As shown with panel 14*d* in FIG. 4, the channels 28*a* and 28*b* of each panel 14 of the second row are aligned with a desired pair of rigid connector rods 36, after which the panel is slid thereon. After the panels 14 of the second row have been mounted onto a pair of connector rods 36, a set of elastic stretch chords 32 are then inserted into and extended through respective channels 26*a* and 26*b* in the same manner as described hereinabove with respect to the bottom row of panels. As shown in FIG. 7, additional rows of panels 14** can be added as desired by repeating the above described assembly process.

The modular panel system 10 of the present invention achieves a significant reduction in weight and complexity over known modular portable display systems because of the elimination of any interconnecting hinge mechanisms and the attendant support structure therefor. The modular panel system 10 described herein allows for an unrestricted number of different freestanding display, or room partition, configurations by simply rearranging the positions of the panels, adding or removing panels, and bending the freestanding structure along various flexible panel interconnections.

It is further noted with respect to the interconnection of abutting panels, the use of channels **26*a* and 26*b* and an independent connecting means in the present system allows for selection of a flexible or rigid connection along the horizontal plane of the assembled freestanding structure. For example, horizontally abutting panels 14 can be interconnected by a set of straight rigid connecting rods inserted into respective channels 26*a* and 26*b***, or a set of angled rigid connecting rods designed to create a particular freestanding configuration upon assembly.

It is also noted at least one light box panel for illuminating graphic arts or other visual aid material can be incorporated into the modular panel system 10 of the present invention. The light box panel would be formed from a hollow core, or frame, having the appropriate channels **26*a* and 26*b*, and 28*a* and 28*b***, extending internally of the frame, and illumination components such as a light fixture placed within the hollow core. A facing comprised of a nonopaque sheet would be placed on the hollow core to allow the backlighting of any desired graphic art material incorporated onto the facing of the light box panel.

While the preferred embodiment has been described with respect to a freestanding portable exhibit display, or room partition, it will be appreciated the modular panel system of the present invention can be used to erect structures such as multi-sided columns or towers, and tables. Further, the panels can be constructed of suitable lightweight housing material to allow the modular panel system of the present invention to be used for assembling portable, temporary housing structures.

It will be understood that the foregoing description of the preferred embodiment of the present invention is for illustrative purposes only, and that the various structural and operational features herein disclosed are susceptible to a number of modifications, none of which departs from the spirit and scope of the present invention as defined in the appended claims.

I claim:

1. A modular panel system for erecting a portable exhibit display, or room partition, comprising:

a plurality of structural panels each having a first set of at least two parallel channels extending inside the panel from one side to an opposite side; and a first plurality of connecting members for horizontally interconnecting said plurality of structural panels to erect said portable exhibit display, or room partition, each of said first plurality of connecting members being inserted into a respective one of said first set of at least two parallel channels in an end one of horizontally abutting panels, and extending through a corresponding one of the first set of at least two parallel channels in the remaining horizontally abutting panels.

2. The modular panel system of claim 1 wherein each of said plurality of structural panels further comprises a second set of at least two parallel channels extending inside the panel perpendicular to said first set of at least two parallel channels; and a second plurality of connecting members for vertically interconnecting the plurality of horizontally interconnected structural panels, each of said second plurality of connecting members being inserted into a respective one of said second set of at least two parallel channels in a particular one of the plurality of horizontally interconnected structural panels, and extending into a respective one of the second set of at least two parallel channels in a vertically abutting structure panel.

3. The modular panel system of claim 2 wherein each of said plurality of structural panels comprises at least two overlapping sheets of lightweight material, said first set of at least two parallel channels being formed in one of said at least two overlapping sheets, and said second set of at least two parallel channels being formed in another one of said at least two overlapping sheets.

4. The modular panel system of claim 3 wherein each of said plurality of structural panels further comprises an outer cover which completely encloses said at least two sheets of lightweight material.

5. The modular panel system of claim 1 wherein said first plurality of connecting members each comprises an elastic stretch chord.

6. The modular panel system of claim 5 further comprising a securing means which attaches to each end of the plurality of elastic stretch chords to secure each elastic stretch chord in position relative to the interconnected structural panels.

7. The modular panel system of claim 2 wherein said second plurality of connecting members each comprise a rigid connecting rod.

* * * * *